US010837346B2

(12) United States Patent
Takeuchi

(10) Patent No.: US 10,837,346 B2
(45) Date of Patent: Nov. 17, 2020

(54) HEAT EXCHANGE MODULE

(71) Applicant: DENSO CORPORATION, Kariya (JP)

(72) Inventor: Kazuhiro Takeuchi, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/063,840

(22) PCT Filed: Dec. 19, 2016

(86) PCT No.: PCT/JP2016/087752

§ 371 (c)(1),
(2) Date: Jun. 19, 2018

(87) PCT Pub. No.: WO2017/110733

PCT Pub. Date: Jun. 29, 2017

(65) Prior Publication Data

US 2018/0371979 A1 Dec. 27, 2018

(30) Foreign Application Priority Data

Dec. 25, 2015 (JP) ..... 2015-253784
Oct. 31, 2016 (JP) ..... 2016-212720

(51) Int. Cl.

| | |
|---|---|
| ***F01P 5/06*** | (2006.01) |
| ***F04D 29/56*** | (2006.01) |
| ***F01P 11/14*** | (2006.01) |
| ***F01P 11/10*** | (2006.01) |
| ***F04D 29/52*** | (2006.01) |
| ***F04D 19/00*** | (2006.01) |

(52) U.S. Cl.

CPC ..... *F01P 5/06* (2013.01); *F01P 11/10* (2013.01); *F01P 11/14* (2013.01); *F04D 19/002* (2013.01); *F04D 29/522* (2013.01); *F04D 29/563* (2013.01); *F01P 2031/00* (2013.01)

(58) Field of Classification Search

CPC combination set(s) only.
See application file for complete search history.

(56) References Cited

U.S. PATENT DOCUMENTS 7,631,618 B2 * 12/2009 Hall ..... F01P 5/04 123/41.1
2014/0334917 A1 * 11/2014 Yoshida ..... F04D 29/164 415/119

FOREIGN PATENT DOCUMENTS

| | | |
|---|---|---|
| JP | 2000345845 A | 12/2000 |
| JP | 2008038776 A | 2/2008 |
| JP | 2009109103 A | 5/2009 |

* cited by examiner

*Primary Examiner* — Gordon A Jones
(74) *Attorney, Agent, or Firm* — Harness, Dickey & Pierce, P.L.C.

(57) ABSTRACT

A heat exchange module has a restriction protrusion that is provided to protrude between a blade of a cooling fan and a core portion of a heat exchanger and that restricts the blade from approaching the core portion more than a predetermined position. In a state where one side of an outline of a rectangular shaped fan shroud is disposed so as to face an installation surface, the restriction protrusion is provided in a position where the amount of water reaching the cooling fan through the heat exchanger becomes greater than the amount of water at position just below a rotation axis of the cooling fan in a case where at least a portion of the fan shroud is submerged in water.

8 Claims, 8 Drawing Sheets

HEAT EXCHANGE MODULE

CROSS REFERENCE TO RELATED APPLICATIONS

This application is a U.S. National Phase Application under 35 U.S.C. 371 of International Application No. PCT/JP2016/087752 filed on Dec. 19, 2016 and published in Japanese as WO 2017/110733 A1 on Jun. 29, 2017. This application is based on and claims the benefit of priority from Japanese Patent Application No. 2015-253784 filed on Dec. 25, 2015, and Japanese Patent Application No. 2016-212720 filed on Oct. 31, 2016. The entire disclosures of all of the above applications are incorporated herein by reference.

TECHNICAL FIELD

The present disclosure relates to a heat exchange module including a heat exchanger, a cooling fan, and a fan shroud.

BACKGROUND ART

A conventional heat exchange module includes a heat exchanger having a core portion, a suction type cooling fan provided side by side with respect to the heat exchanger so as to send a cooling air to the core portion of the heat exchanger, and a fan shroud housing the cooling fan and configured to guide the cooling air to pass through the core portion.

The conventional heat exchange module is mainly mounted on a vehicle. When the vehicle drives on a road with a high water level such as a flood road in a submerged state, water may reach the cooling fan through the heat exchanger. At this time, if the cooling fan is operating, the cooling fan is deformed toward the heat exchanger by the propelling force of the cooling fan. The cooling fan interferes with the core portion of the heat exchanger and damages the core portion, and as a result, vehicle troubles such as leakage of cooling water in the heat exchanger, breakage of the cooling fan, overheating and the like may occur. In Patent Literature 1, in order to prevent the cooling fan from interfering with the core portion of the heat exchanger and damaging the core portion, a restriction protrusion protruding between the cooling fan and the core portion of the heat exchanger is provided just below a rotation axis of the cooling fan and functions as a stopper for suppressing the deformation of the cooling fan.

PRIOR ART LITERATURES

Patent Literature

Patent Literature 1: Japanese Patent Publication No. 2009-109103

SUMMARY OF INVENTION

The restriction protrusion described in Patent Literature 1 requires further improvement in order to function as the stopper for suppressing the deformation of the cooling fan.

It is an object of the present disclosure to provide the heat exchange module which surely prevents the cooling fan from interfering with the core portion of the heat exchanger and damaging the core portion.

According to one aspect of the present disclosure, a heat exchange module includes a heat exchanger including a core portion, an outer shape of which is formed in a rectangular shape and inside of which a heat exchange medium is flowed. An axial flow type cooling fan includes a plurality of blades provided in a rotation direction and arranged side by side with respect to the core portion, and the cooling fan generates a cooling air to cool the heat exchange medium through outside of the core portion in a direction from a side of the core portion to a side of the cooling fan. A fan shroud, an outer shape of which is formed in a rectangular shape corresponding to the core portion is provided so as to face the core portion, and the fan shroud includes a cylindrical shaped accommodating portion accommodating the cooling fan and a duct shaped air guiding portion extended from the accommodating portion to the core portion so as to pass the cooling air through the core portion. A restrict protrusion is provided to protrude between the blade of the cooling fan and the core portion in the accommodating portion or in the air guiding portion so as to restrict the blade from approaching the core portion more than a predetermined position. Further, in a state where one side of the outline of the rectangular shaped fan shroud is disposed so as to face an installation surface, the restriction protrusion is arranged in a position where the amount of water reaching the cooling fan through the heat exchanger becomes greater than the amount of water at a position just below a rotation axis of the cooling fan in a case where at least a portion of the fan shroud is submerged in water.

By providing the restriction protrusion, it is possible to suppress the maximum displacement of the blade of the cooling fan, and it is possible to suitably prevent interference problem with the core portion of the radiator due to the deformation of the cooling fan

EMBODIMENTS FOR CARRYING OUT INVENTION

Figure 1:
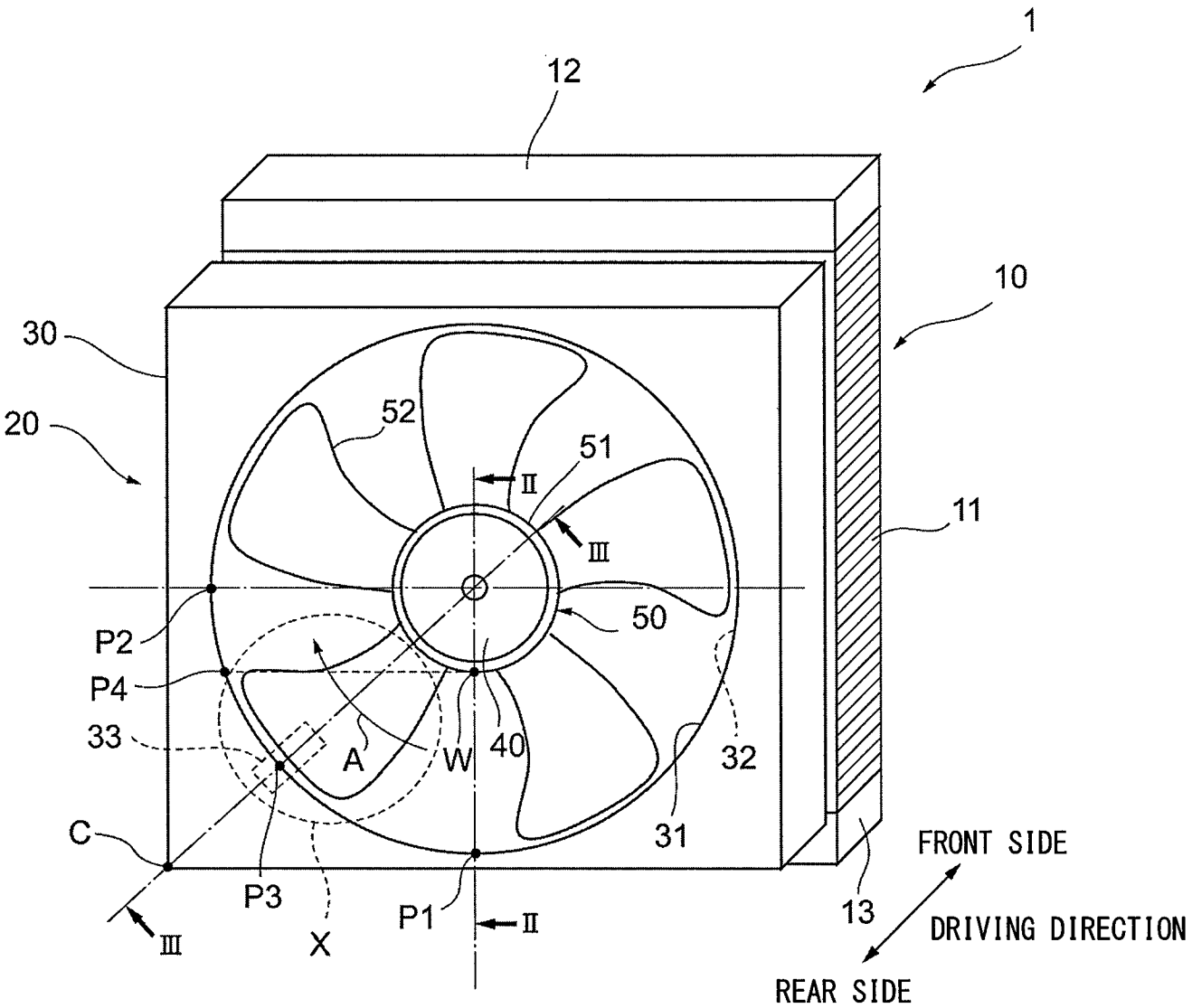
FIG. 1 is a diagram illustrating a schematic view of a heat exchange module in a first embodiment.

Plural embodiments in the present disclosure are explained below with reference to the drawings. In each of the following embodiments, a part that corresponds to a matter described in the preceding embodiment may be assigned with the same reference numeral, and the description thereof may be omitted.

First Embodiment

Figure 2:
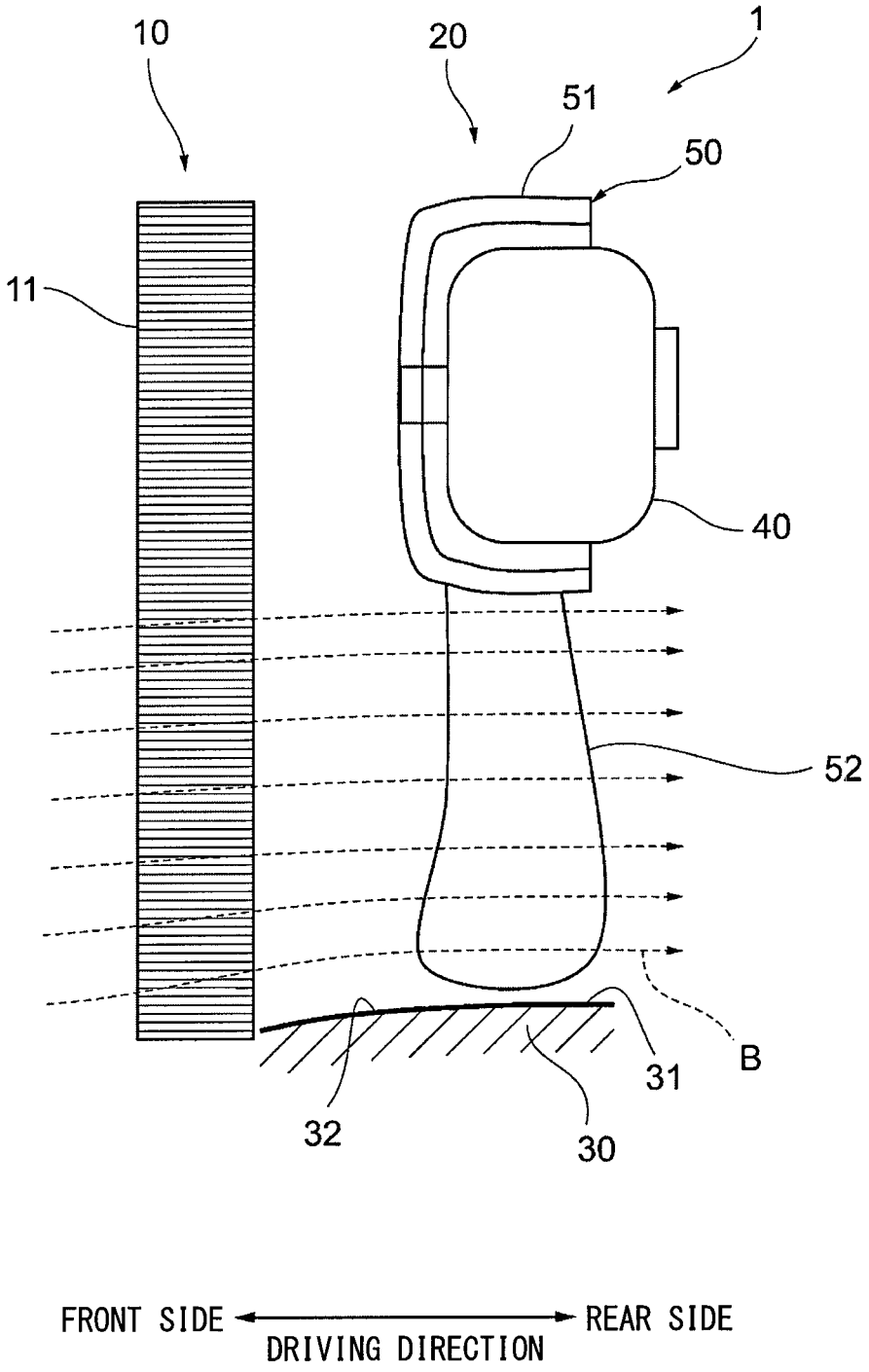
FIG. 2 is a diagram illustrating a cross sectional view taken along line II-II in FIG. 1.

A first embodiment will be described with reference to FIGS. 1 to 3. As shown in FIG. 1, a heat exchange module 1 according to the first embodiment comprises a radiator 10 and an electric blower 20, and the heat exchange module 1 cools a cooling water for an automobile engine. The heat exchange module 1 is mounted on the front side in the driving direction of the vehicle relative to the engine in a vehicle engine room (not shown). The radiator 10 and the electric blower 20 are arranged side by side along the driving direction, and the radiator 10 is installed on the front side in the driving direction with respect to the electric blower 20. The electric blower 20 is installed on the engine side (the rear side in the driving direction) of the radiator 10.

With respect to the driving direction, in FIG. 1, a back side of a page is referred to as a front side, and a near side of the page is referred to as a back side. In FIGS. 2 and 3, a left side of the page is referred to as the front side, and a right side of the page is referred to as the back side. Further, in the following description, in FIGS. 1 to 3, a vertical direction of the paper is referred to as the vertical direction.

The radiator 10 (a heat exchanger) has a core portion 11 having a rectangular outer shape by stacking a plurality of tubes 10 such that a longitudinal direction of the tube faces upward and downward. Both ends in the longitudinal direction of the tube are connected to a pair of tanks, that is, an upper tank 12 and a lower tank 13. The radiator 10 is a so-called vertical flow type radiator.

In the radiator 10, here, the cooling water (heat exchange medium) from the engine is introduced from the upper tank 12, flows in the tube of the core part 11 from the upper side to the lower side in FIG. 1, and then flows out from the lower tank 13. The cooling water is returned to the engine. The flow direction of the cooling water in the radiator 10 is not limited to this configuration.

The electric blower 20 is mainly composed of a fan shroud 30, an electric motor 40, and a cooling fan 50, and the cooling fan 50 is attached to the fan shroud 30 so that a rotating shaft of the cooling fan 50 faces in a horizontal direction. The electric blower 20 blows the cooling air to the core portion 11 of the radiator 10. The electric blower 20 sucks the blown air from a grill side of the vehicle toward the engine side thereof, that is, from the core portion 11 of the radiator 10 toward the fan shroud 30. The electric blower 20 is a so-called suction-type electric blower.

The outline of the fan shroud 30 is formed in a rectangular shape (substantially square shape) corresponding to the core portion 11 of the radiator 10, and is made of, for example, a polypropylene resin material containing glass fibers, and is integrally formed by an injection molding. The fan shroud 30 is arranged to face the core portion 11 of the radiator 10. The fan shroud 30 of the electric blower 20 is installed together with the core portion 11 of the radiator 10 such that one side of the rectangular outline faces an installation surface.

The fan shroud 30 is provided with a stepped cylindrical shroud ring portion 31 (accommodating portion) in a portion which is the outer periphery of the cooling fan 50. A cylindrical motor holding portion (not shown) is formed at the center of the shroud ring portion 31. The motor holding portion includes a plurality of motor stay portions (not shown) extending radially and connected to the shroud ring portion 31. The shroud ring portion 31 accommodates the cooling fan 50 so as to be rotatable within the fan shroud 30.

A duct-like shroud baffle portion 32 (air guiding portion) which is smoothly inclined is formed between the shroud ring portion 31 and an outer peripheral edge portion of the shroud 30 on the side of the core portion 11 of the radiator 10, and the duct-like shroud baffle portion 32 efficiently guides the airflow sucked by the cooling fan 50 over the entire area of the core portion 11 of the radiator 10. A restriction protrusion 33 is formed on an inner surface of a connecting portion between the shroud ring portion 31 and the shroud baffle portion 32. The restriction protrusion 33 will be described later in detail.

The electric motor 40 is, for example, a ferrite type direct current motor, and the ferrite magnet as a stator is fixed to an inner circumferential surface of a cylindrical housing forming a main body, and an armature (coil) as a rotor is rotatably provided inside of the stator. The electric motor 40 is fixed to a motor holding portion of the fan shroud 30.

The cooling fan 50 includes a boss portion 51 having a flat bottomed cylindrical shape, and a plurality of blades 52 being disposed in the circumferential direction (a rotational direction A around the rotation axis) of the boss portion 51, and extending radially while being separated from each other. The cooling fan 50 is an axial flow fan. The cooling fan 50 is formed by integrally molding the boss portion 51 and the blade 52, for example, by using a polypropylene resin material containing glass fibers. The cooling fan 50 is housed (enclosed) inside the shroud ring portion 31 of the fan shroud 30, and is fixed to the rotation shaft of the electric motor 40 so as to be rotatably driven by the electric motor 40. That is, the cooling fan 50 is arranged side by side with respect to the core portion 11 of the radiator 10. The cooling fan 50 generates the cooling air for cooling the internal cooling water along the outside of the core portion 11 so as to flow in a direction B from the side of the core portion 11 to the side of the cooling fan 50.

The above-mentioned restriction protrusion 33 protrudes radially inward (the direction toward the rotational axis) from a connecting portion (an end portion on the side of the core portion 11 of the shroud ring portion 31) between the shroud ring portion 31 of the fan shroud 30 and the shroud baffle portion 32 thereof. The restriction protrusion 33 is formed in a thin plate shape having the same thickness as the other portion of the fan shroud 30 and has a substantially rectangular shape.

Figure 3:
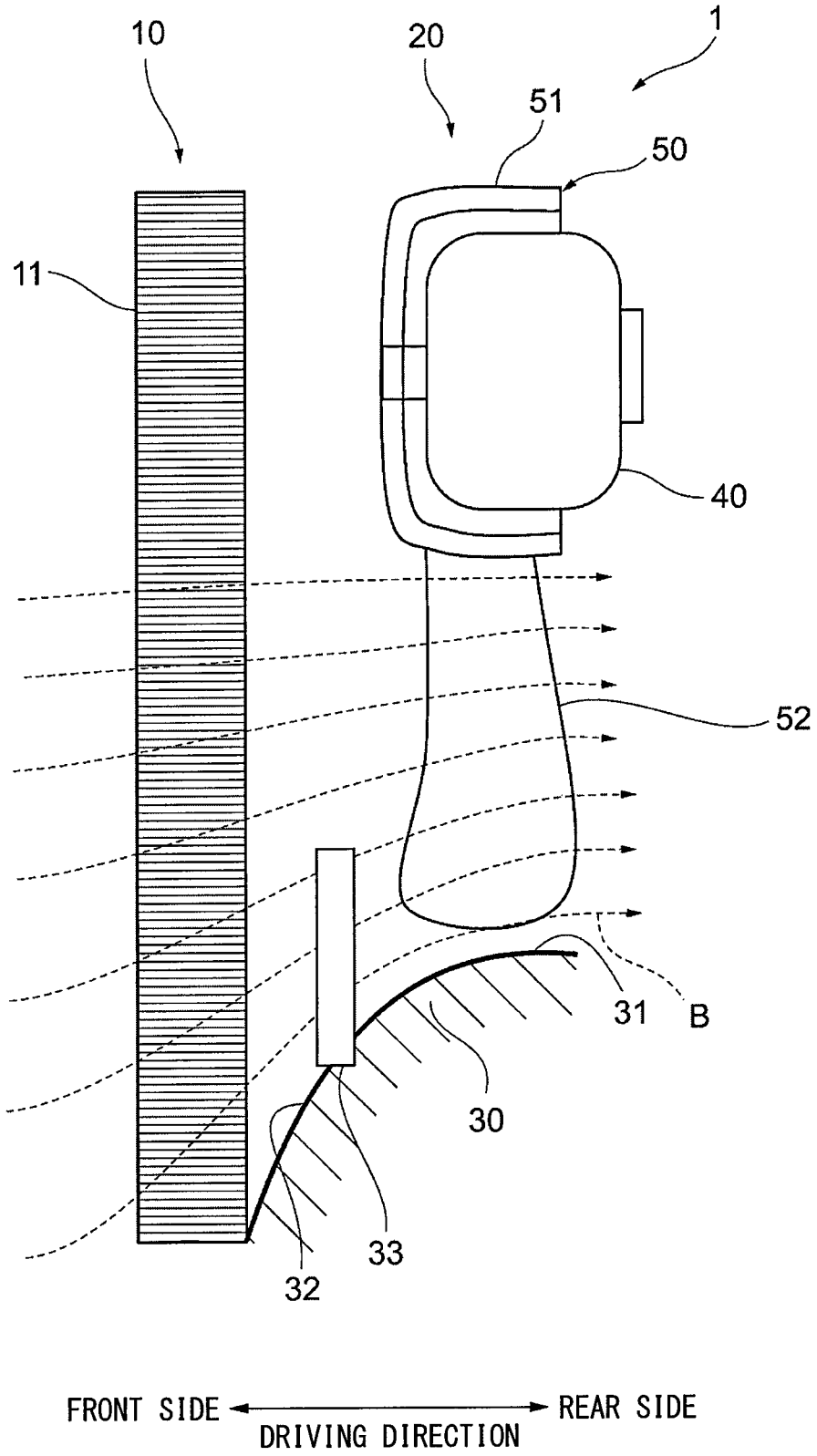
FIG. 3 is a diagram illustrating a cross sectional view taken along line III-III in FIG. 1 and a cross sectional view of a main part of the heat exchange module in the first embodiment.

As shown in FIG. 3, the restriction protrusion 33 is provided to protrude between the blade 52 of the cooling fan 50 and the core portion 11 of the radiator 10. As described above, when the vehicle on which the heat exchange module 1 is mounted drives in a submerged state on a road with a high water level, such as on a flooded road, water may reach the cooling fan 50 through the radiator 10. At this time, during the operation of the cooling fan 50, a thrust force is applied to the side of the core portion 11, when the blade 52 passes underwater. An end portion of the blade 52 in the centrifugal direction is deformed toward the core portion 11 (front side in the driving direction) by the thrust force. The restriction protrusion 33 can restrict the blade 52 from approaching the core portion 11 more than the predetermined position, when the blade 52 of the cooling fan 50 is deformed.

In the present embodiment, as shown in FIG. 1, in a state in which one side of the rectangular outline of the fan shroud 30 is installed so as to face the installation surface, the restriction protrusion 33 is arranged so that the amount of water that reaches the cooling fan 50 through the radiator 10 is larger than the amount of water that reaches just below the rotation axis of the cooling fan 50, when at least a part of the fan shroud 30 is submerged in water.

More specifically, the restriction protrusion 33 is provided in a range of a position P1 to a position P2. The position P1 is just below the rotation axis of the cooling fan 50 (hereinafter also referred to as "just below position P1"), and the position P2 is a position that advances in the rotation direction A of the cooling fan 50 and is the same height as the rotation center of the cooling fan 50. In the embodiment of FIG. 1, the position P2 is a position advanced by 90 degrees in the rotation direction A of the cooling fan 50 from the just below position P1. Here, the reason why the setting position of the restriction protrusion 33 is determined in this manner will be described.

A configuration in which a stopper for suppressing deformation of the cooling fan is provided is already suggested like the restriction protrusion 33 of the present embodiment (see, for example, Patent Literature 1). However, conventionally, the element as such stopper function was provided at a position just below the rotation axis of the cooling fan 50 (corresponding to the position P1 in FIG. 1). In the case of submergence, it is assumed that the position P1 in the cooling fan 50 is in a relatively high water level and the submerged area of the blade 52 becomes the maximum, so that the deformation of the blade 52 is also maximized.

However, as a result of intensive research, as shown in FIG. 1, a maximum deformation region X where maximum deformation of the blade 52 of the cooling fan 50 occurs due to the influence of the water flow is not the position P1 just below the rotation axis. The maximum deformation region X exists on the side of the rotation direction A of the cooling fan 50 from the position P1, namely between the position P1 and the position P2 that advances in the rotation direction A of the cooling fan 50 and is the same height as the rotation center of the cooling fan 50.

At the position P1 just below the rotation axis, the area of the core portion 11 on the front side of the radiator 10 is small as indicated by an arrow B in FIG. 2, so that the amount of water flowing into the cooling fan 50 is only the amount of water in front of the cooling fan 50, and it becomes a relatively small amount. On the other hand, on the side of the rotation direction A relative to the position P1, the water which passes not only a part of the core portion 11 facing the cooling fan 50 but also other part of the core portion not facing the cooling fan 50 on the outer circumference of the cooling fan 50 is guided by the shroud baffle 32 and flows in, so that the amount of water flowing into the cooling fan 50 increases as compared with that of water at the position P1.

In particular, at a position P3 at which a straight line connecting between a corner portion C (a corner portion in contact with the installation surface in the direction advanced from the position P1 in the rotation direction A) of the fan shroud 30 and the rotation center of the cooling fan 50 is intersected with the shroud ring portion 31, as indicated by the arrow B in FIG. 3, the area of the part of the core portion 11 not facing the cooling fan 50 becomes the largest so that the amount of water flowing to the cooling fan 50 becomes maximum. In other words, it is considered that the maximum deformation region X where maximum deformation in the blade 52 of the cooling fan 50 occurs exists at the position P3, and the installation of the restriction protrusion 33 at this position P3 is most effective as the stopper function. This position P3 is also referred to as "water amount maximum position P3" in the following description. In the case where the fan shroud 30 has a substantially square shape as shown in FIG. 1, the maximum water amount position P3 is at a position of 45° in the rotation direction A from the position P1 just below the rotation axis.

The range in which the amount of water increases as described above is limited to the position P2, which advances further toward the rotation direction A from the position P3, and at which the area of the part of the core portion 11 not facing the cooling fan 50 is again reduced to the same as at the position P1, and which is the same height as the rotation center of the cooling fan 50. The reason why the region advancing in the rotation direction A further from the position P2 (that is, the position advanced by 90 degrees or more from the position P1) is not included in the water amount increasing range is described as follows. When the cooling fan 50 submerges in these regions, the electric motor 40 disposed at the rotation center of the fan 50 is also in a state of being submerged, so that it is difficult to rotate the cooling fan 50.

Therefore, since the restriction protrusion 33 is provided in the region from the position P1 to the position P2 where the position P1 is just below the rotation axis and the position P2 is the same height as the rotation center of the cooling fan 50 by advancing in the rotation direction A, the restriction protrusion 33 is arranged at a position at which the water amount is larger than the water amount at the position just below the rotation axis of the cooling fan 50. Providing the restriction protrusion 33 in this manner makes it possible to suppress the maximum deformation of the blade 52 of the cooling fan 50 and to prevent the interference problem of the radiator 10 to the core portion 11 due to the deformation of the cooling fan 50. As a result, the heat exchange module 1 according to the present embodiment can suitably prevent the cooling fan 50 from interfering with the core portion 11 of the radiator 10 and damaging the core portion 11.

The term "damage" assumed here means, for example, that a tip portion of the blade reaches the front side of the front radiator 10 due to deformation of the cooling fan 50, the tip portion interferes with the core portion 11 and is damaged, and in some cases, a tube breakage of the core portion 11 is occurred. As a result of a survey on market collection products, the interference marks of the radiator 10 caused by the cooling fan 50 increase little by little from the position P1 just below the rotation axis of the cooling fan 50, and the number of the interference marks becomes maximum at the position (the water amount maximum position P3) which advances approximately 45 degrees in the rotation direction of the cooling fan 50 from just below the rotation axis of the cooling fan 50. Further the interference marks are concentrated in the range (the region between the point P1 and the point P2) from the point just below the rotation axis of the cooling fan 50 to 90 degrees in the rotation direction, especially are remarkable at a position of about 45 degrees (the water amount maximum position P3). When the tube breakage occurs, the cooling water in the radiator 10 leaks, and sufficient cooling water is not returned to the engine, finally in some cases, the overheating of the engine may be caused.

In addition, the installation regions of the restriction protrusion 33 described above between the position P1 and the position P2 are the maximum ranges in which the present embodiment can exhibit its effect. It is preferably to provide the restriction protrusion 33 in the range between the above-mentioned just below position P1 and a position P4 that advances in the rotational direction A of the cooling fan 50 and that is the same height as the blade root position W just below the rotation axis of the blade 52 of the cooling fan 50. Further, it is more preferable that the restriction protrusion 33 is provided in the range between P1 and P3 from the position just below the rotation axis of the cooling fan 50 to the above-mentioned maximum water amount position P3, more preferably provided at the maximum water position P3. By further limiting the installation position of the restriction protrusion 33 in this manner, the effect of suppressing the maximum deformation of the blade 52 of the cooling fan 50 can be further improved.

Further, only one restriction protrusion 33 is provided on the inner side surface of the connecting portion between the shroud ring portion 31 and the shroud baffle portion 32. By minimizing the number of the restriction protrusion 33 to be installed, ease of assembly of the cooling fan 50 to the fan shroud 30 can be maintained, and an increase in manufacturing cost can be suppressed.

The restriction protrusion 33 may restrict the blade 52 of the cooling fan 50 from approaching the core portion 11 more than a predetermined position and may be formed on the inner peripheral surface of the shroud ring part 31 or of the shroud baffle portion 32 at any position.

Second Embodiment

Figure 4:
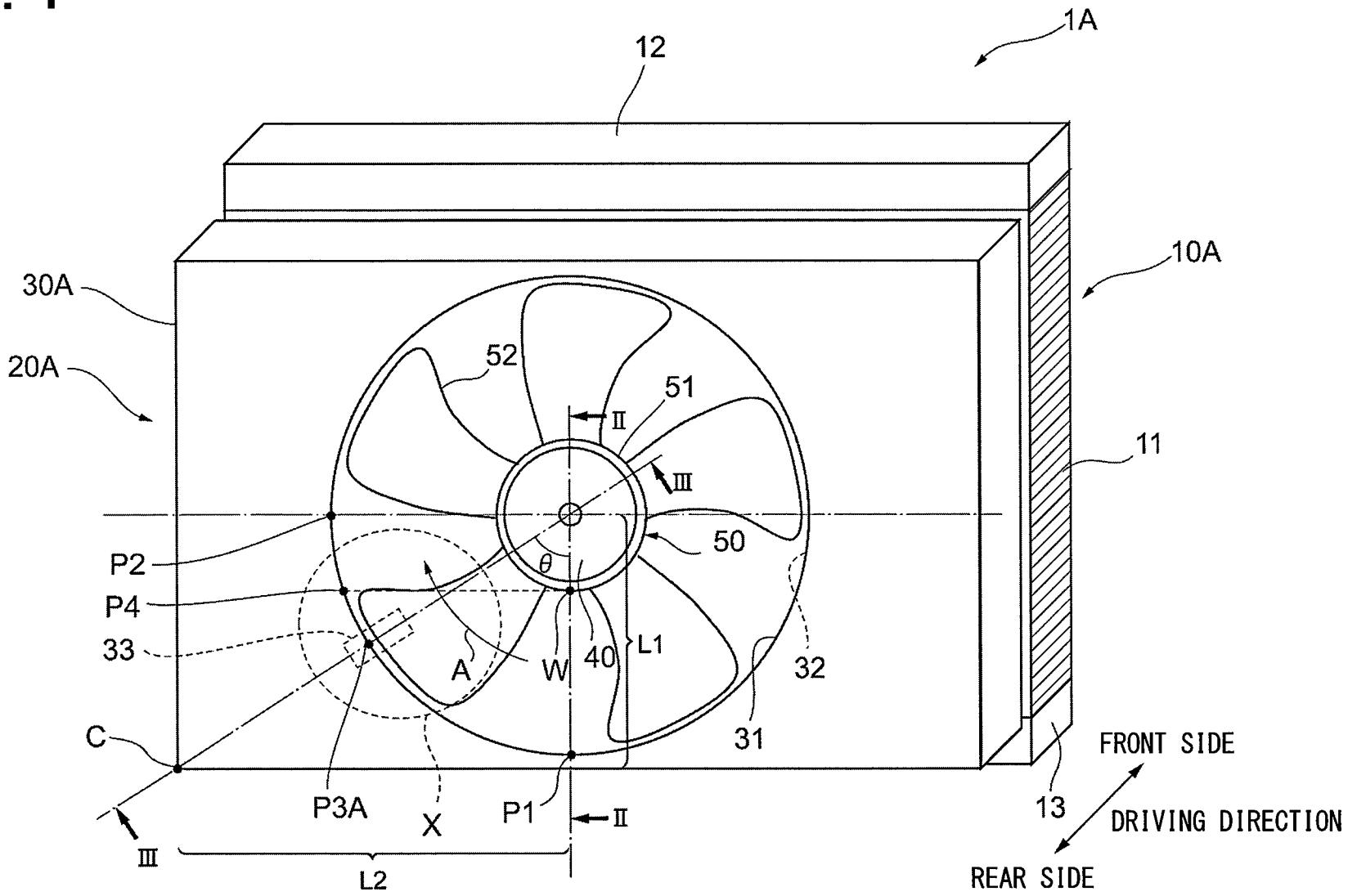
FIG. 4 is a diagram illustrating a schematic view of a heat exchange module in a second embodiment.

The second embodiment is explained with reference to FIG. 4. As shown in FIG. 4, the heat exchange module 1A according to the second embodiment is differ from the heat exchange module 1 in the first embodiment relating to the shape of the core portion 11 of the radiator 10A and the fan shroud 30A of the electric blower 20A which are formed in a substantially rectangular shape. With respect to the core portion 11 of the radiator 10A and the fan shroud 30A of the electric blower 20A, one side of a long side of the rectangular outline faces the installation surface.

In the second embodiment, as in the first embodiment, the restriction protrusion 33 is provided in the range P1 to P2 where the position P1 is just below the rotation axis and the position P2 is the same height as the rotation center of the cooling fan 50 by advancing in the rotation direction A. It is preferably to provide the restriction protrusion 33 in the region between the above-mentioned just below position P1 and the position P4 that advances in the rotational direction A of the cooling fan 50 and that is the same height as the blade base position W just below the rotation axis of the blade 52 of the cooling fan 50. Further, it is more preferable that the restriction protrusion 33 is provided in the range between P1 and P3A between the position just below the rotation axis of the cooling fan 50 and the above-mentioned maximum water amount position P3A, more preferably provided at the maximum water position P3A.

The heat exchange module 1A according to the second embodiment, the area of the core portion 11 not facing the cooling fan 50 at the maximum water amount position P3A becomes the maximum, when a part of the fan shroud 30 submerges. In a case where the fan shroud 30 has a substantially rectangular shape as shown in FIG. 4, the maximum water amount position P3A is set to be at an angle θ (theta) which advances in the rotation direction A from the fan shroud 30 based on the following formula. The angle θ (theta)=arctan (L2/L1). L1 designates a distance from a rotation center of the cooling fan 50 to the position P1 just below the rotation axis, and L2 designates a distance from the position P1 to a corner portion in one side in contact with the installation surface of the fan shroud 30.

Hereinafter, the above embodiment will be described more concretely with examples. However, the present invention is not limited to the following examples. In the following embodiment, at the position P3 where the straight line connecting the corner portion C of the fan shroud 30 and the rotation center of the cooling fan 50 intersects the shroud ring portion 31, the maximum deformation of the blade 52 of the cooling fan 50 occurs. This situation will be described.

Figure 5:
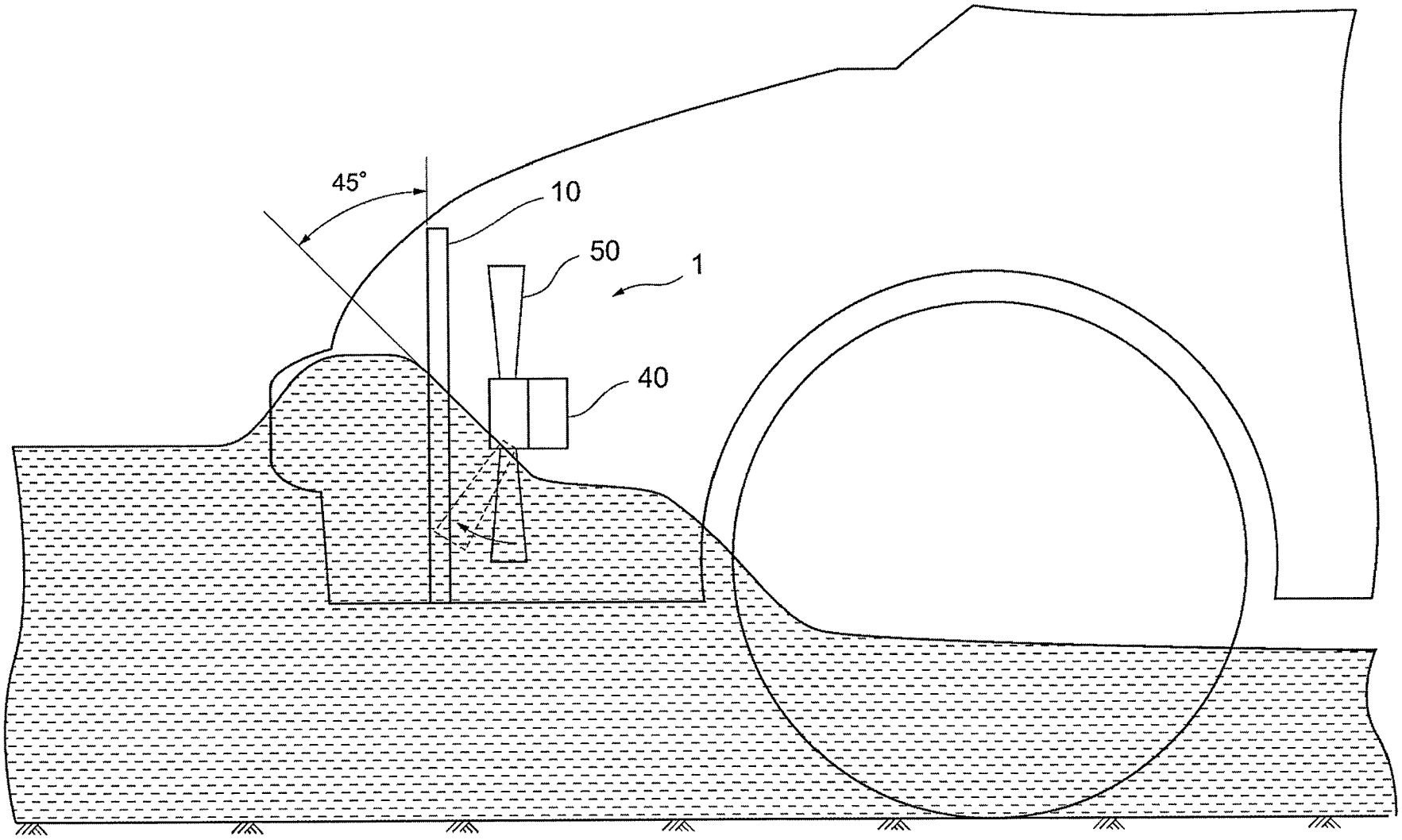
FIG. 5 is a diagram illustrating an overview of an actual car flood road driving test.

At first, as shown in FIG. 5, in a vehicle where the heat exchange module similar to the heat exchange module 1 according to the present embodiment, an actual car flood road driving test was carried out so as to drive on the flood road where the module was submerged. The state of immersion in an ENCOPA (an engine compartment, an engine room) was observed. As a result of this test, it was found that a water level rose in the front of the radiator 10 and water was flooded to the cooling fan 50 at an angle of about 45 degrees when viewed from the side of the vehicle.

Therefore, the engineer devised a bench test simulating the state of flooding water in an actual vehicle flooded at an angle of 45 degrees in a side view, which is observed in the above actual vehicle flood road driving test. In this bench test, the engineer measured a relationship between a flooded position (depth) of the cooling fan 50 and the amount of deformation of the cooling fan 50.

Figure 6:
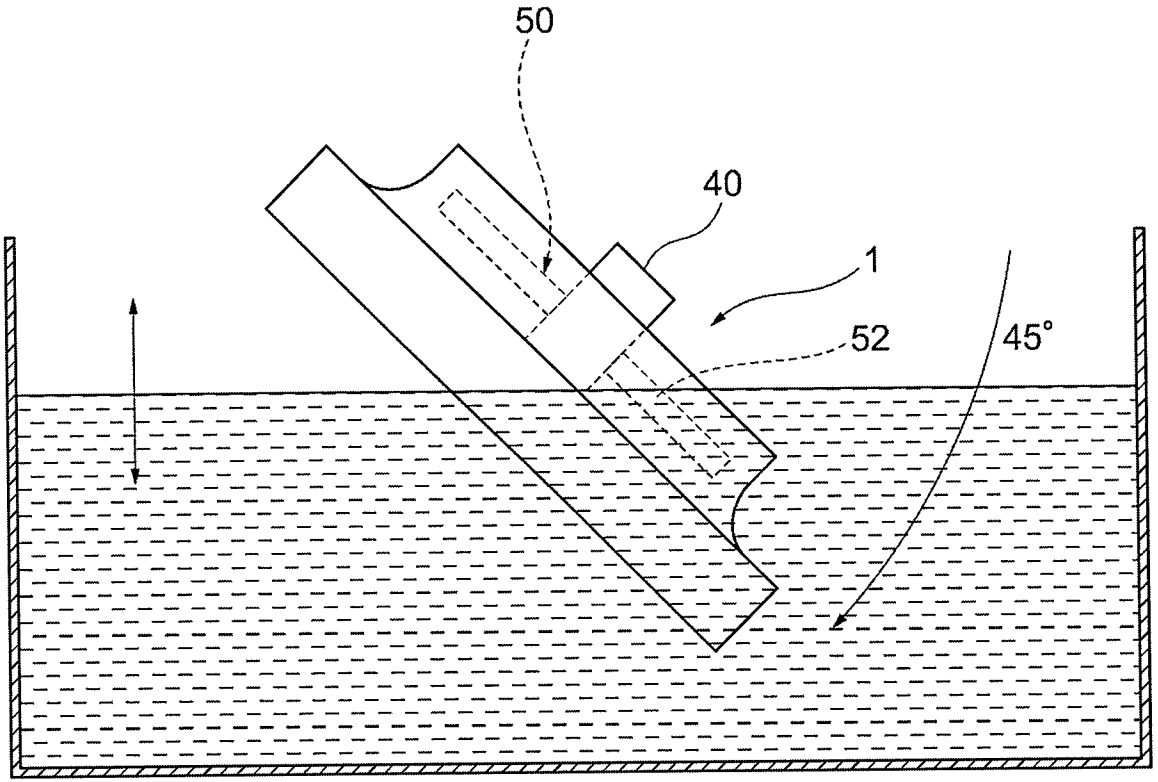
FIG. 6 is a diagram illustrating an overview of a bench test.

In the bench test, a commercially available heat exchange module 1 (the number of blades of the cooling fan: 7, a diameter 340 mm, 13.5V, 80 W) was used. As shown in FIG. 6, the commercially available heat exchange module 1 was inclined at 45 degrees from the horizontal plane and was dropped into a water tank while rotating the cooling fan 50. The positional relationships (water immersion position) between the heat exchange module 1 and the water level of the aquarium are set to the following four types. (1) shows the water level at which ¼ of the tip of the blade 52 on the inclined lower side of the cooling fan 50 is flooded, (2) shows the water level at which ½ of the tip of the blade 52 on the inclined lower side of the cooling fan 50 is flooded, (3) shows the water level at which the blade base of the blade 52 on the slanted lower side of the cooling fan 50 is flooded, and (4) shows the water level at which the central boss portion 51 of the cooling fan 50 and the electric motor 40 connected to the boss portion 51 are flooded. Then, the amount of deformation of the cooling fan 50 at each type of water immersion position in the above mentioned four types was measured. FIG. 6 illustrates a state in which the heat exchange module 1 is submerged to the water level of the above type (3).

Figure 7:
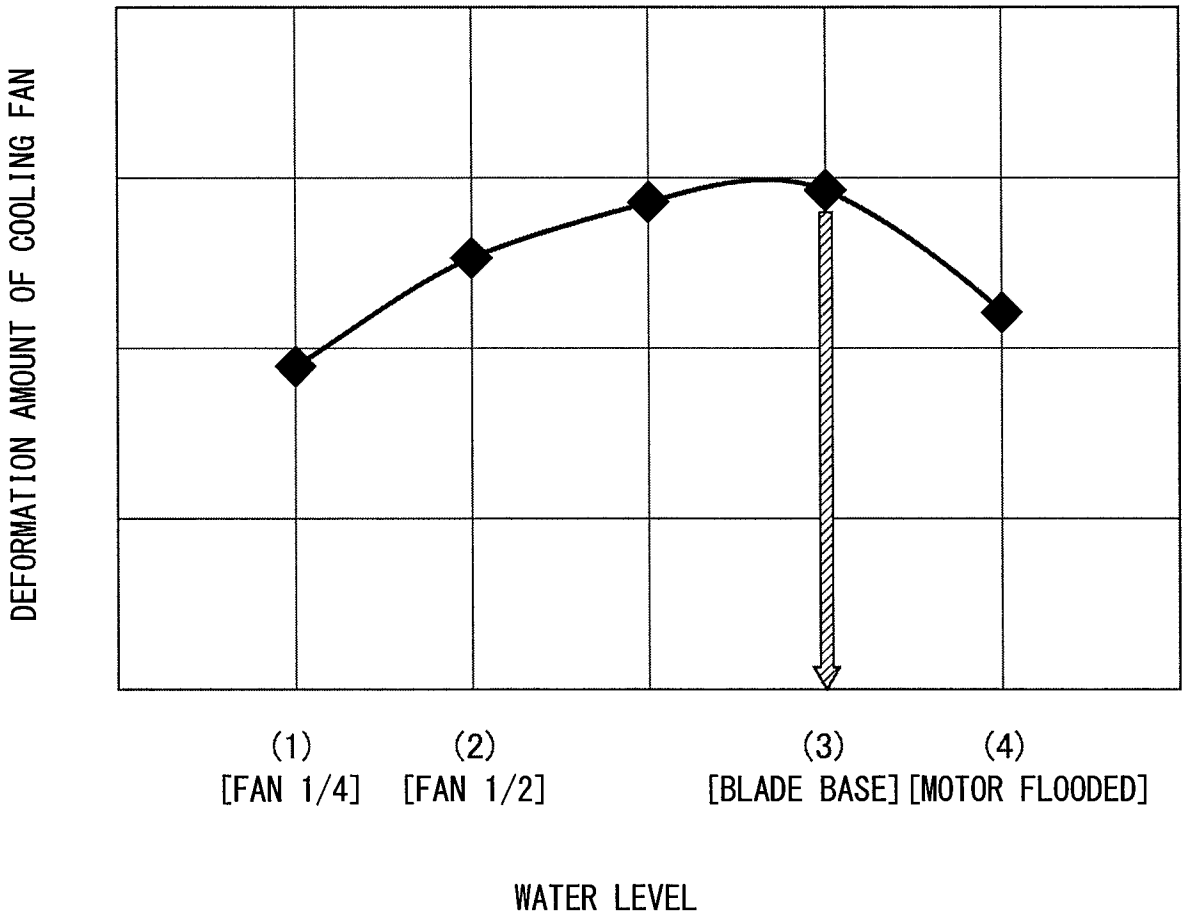
FIG. 7 is a diagram illustrating a result of the bench test, showing a relationship between a water immersion position of the heat exchange module and a deformation amount of a fan.

The result in the bench test is shown in FIG. 7. A lateral axis of FIG. 7 shows the water level, the results based on the water immersion positions in the above mentioned conditions (1) to (4) are shown in order of (1), (2), (3), and (4) from left side. A vertical axis of FIG. 7 shows the deformation amount of the cooling fan 50.

As shown in FIG. 7, the deformation amount at the water immersion position (1) is minimum, the deformation amount increases as the water immersion portion increases. At the water immersion position (3), where the wing base of the blade 52 is flooded, it was confirmed that the amount of deformation becomes the maximum. It is considered that the maximum displacement due to immersion of the blade base position is occurred due to the maximum torque applied to one blade 52 in water. On the other hand, when the water immersion position transits from (3) to (4) and the water immersion position becomes deeper than the blade base, it is confirmed that the rotation speed decreases by increasing a torque applied to the entire cooling fan 50 and the deformation amount decreases. Therefore, from the results of the bench test, when the heat exchange module 1 is flooded up to the blade base position W (the position P4) just below the rotation axis of the blade 52 of the cooling fan 50 in the above embodiment, the maximum amount of deformation of the cooling fan 50 becomes the maximum.

Figure 8:
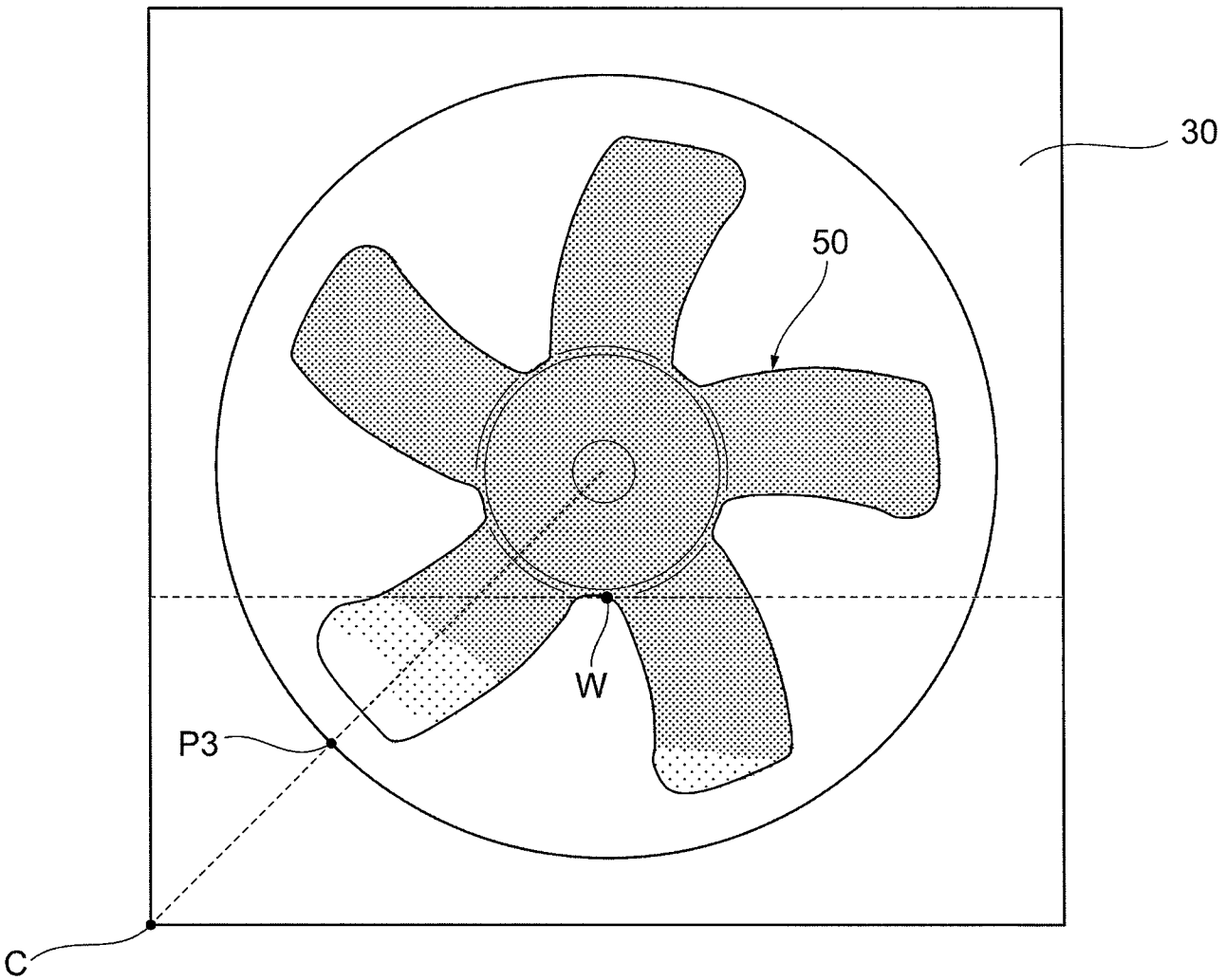
FIG. 8 is an explanatory diagram showing a result of unsteady fluid analysis using a three-dimensional model of the heat exchange module.

Next, based on the results of the bench test, the condition that the module is immersed in the water up to the water level of the wing base in this situation where the maximum amount of deformation is occurred, is set, and the engineer studied an unsteady fluid analysis in two-layer flow of water and air by using the three-dimensional model of the heat exchange module 1. As shown in FIG. 8, in the analysis result using the three-dimensional model, as in the above embodiment, the blade 52 of the cooling fan 50 had the maximum deformation at the intersecting position P3 where the straight line connecting the corner portion C of the fan shroud 30 and the rotation center of the cooling fan 50 intersects with the shroud ring portion 31.

The embodiments of the present disclosure is described above, however, the present disclosure is not limited to the embodiments described above, and can be appropriately changed. Those skilled in the art appropriately design modifications to these specific examples are also included within the scope of the present disclosure as long as they have the features of the present disclosure. The elements, the arrangement, the conditions, the shape, and the like of the respective specific examples described above are not limited to those exemplified and can be appropriately changed. Each element included in each of the above-described specific examples can be appropriately changed in combination as long as no technical inconsistency occurs.

What is claimed is:

1. A heat exchange module, comprising:

a heat exchanger including a rectangular shaped core portion, an inside of the core portion configured to flow a heat exchange medium;

an axial flow type cooling fan having a rotation axis and including a plurality of blades arranged side by side and adjacent to the core portion and configured to rotate about the rotation axis, the cooling fan being configured to pull a cooling air to cool the heat exchange medium through the core portion and toward the cooling fan;

a rectangular shaped fan shroud corresponding to the core portion and provided so as to face the core portion, and the fan shroud including a cylindrical shaped accommodating portion for accommodating the cooling, the accommodating portion having an air guiding portion that extends through the accommodating portion and defines a wall of the accommodating portion, the fan shroud having a horizontal midline and a vertical midline, both the horizontal midline and the vertical midline passing through the rotation axis of the cooling fan; and a restriction protrusion that protrudes from the air guiding portion such that the restriction protrusion is positioned between the plurality of blades of the cooling fan and the core portion so as to restrict the plurality of blades from approaching the core portion, wherein the restriction protrusion protrudes from the air guiding portion entirely and only between a first position on the vertical midline below the horizontal midline and a second position on the horizontal midline, the second position angularly offset from the first position by 90 degrees relative to a rotation direction of the plurality of blades as the plurality of blades rotate from the first position to the second position, and wherein only one restriction protrusion protrudes from the air guiding portion.

2. The heat exchange module according to claim 1, wherein the cooling fan has a boss portion arranged around the rotation axis and connects to a blade base on each of the plurality of blades, and wherein the restriction protrusion protrudes from the air guiding portion between the first position and a third position, the third position being between the first position and the second position, and the third position being on a virtual line that is both orthogonal to the vertical midline and tangential to the boss portion.

3. The heat exchange module according to claim 2, wherein the restriction protrusion protrudes from the air guiding portion between the first position and a fourth position, the fourth position angularly offset from the first position by 45 degrees relative to the rotation direction of the plurality of the blades as the plurality of blades rotate from the first position to the fourth position.

4. The heat exchange module according to claim 3, wherein the restriction protrusion protrudes from the air guiding portion at the fourth position.

5. An axial flow type cooling fan for use in a heat exchange module having a radiator, the cooling fan comprising:

a rectangular prism shaped fan shroud with a first planar face configured to be oriented toward the radiator when the cooling fan is installed in an installation position against the radiator, a second planar face disposed opposite the first planar face and oriented away from the radiator when the cooling fan is installed in the installation position, a cylindrical shaped bore disposed centrally within the fan shroud and extending through the fan shroud from the first planar face to the second planar face, a baffle portion extending from the first planar face to the second planar face to define a wall of the bore, and a restriction protrusion disposed within the bore and extending from the baffle portion toward a center of the bore;

a motor disposed centrally within the bore and having an axis of rotation coaxial to the center of the bore; and a blade assembly having a hub disposed within the bore and coaxial to the axis of rotation of the motor, the hub configured to be rotated by the motor, and a plurality of fan blades extending radially from the hub toward the baffle portion, the plurality of fan blades configured to rotate within the bore in a rotation direction in response to the hub being rotated by the motor, wherein the fan shroud has a horizontal midline and a vertical midline relative to the installation position, both the horizontal midline and the vertical midline passing through the axis of rotation of the motor, and wherein the restriction protrusion is disposed on the baffle portion (i) between the blade assembly and the first planar face, and (ii) entirely and only between a first position on the vertical midline below the horizontal midline and a second position on the horizontal midline, the second position being angularly offset from the first position by 90 degrees relative to the rotation direction as the plurality of fan blades rotate from the first position to the second position, and wherein the restriction protrusion is configured to prevent the plurality of fan blades rotating between the first position and the second position from deforming and contacting the radiator when the cooling fan is installed in the installation position and the plurality of fan blades rotate from the first position to the second position, and wherein the restriction protrusion extending from the baffle portion is only a singular restriction protrusion.

6. The axial flow type cooling fan of claim 5, wherein the restriction protrusion is disposed on the baffle portion between the first position and a third position, the third position being angularly offset from the first position by 45 degrees relative to the rotation direction as the plurality of fan blades rotate from the first position to the third position, and wherein the third position is equidistant between the first position and the second position, and wherein the restriction protrusion is further configured to prevent the plurality of fan blades rotating between the first position and the third position from deforming and contacting the radiator when the cooling fan is installed in the installation position and the plurality of fan blades rotate from the first position to the third position.

7. The axial flow type cooling fan of claim 5, wherein the restriction protrusion is disposed on the baffle between a third position and the second position, the third position being angularly offset from the first position by 45 degrees relative to the rotation direction as the plurality of fan blades rotate from the first position to the third position, and wherein the third position is equidistant between the first position and the second position, and wherein the restriction protrusion is further configured to prevent the plurality of fan blades rotating between the third position and the second position from deforming and contacting the radiator when the cooling fan is installed in the installation position and the plurality of fan blades rotate from the third position to the second position.

8. The axial flow type cooling fan of claim 5, wherein the restriction protrusion is disposed on the baffle at a third position that is angularly offset from the first position by 45 degrees relative to the rotation direction as the plurality of fan blades rotate from the first position to the third position, and wherein the third position is equidistant between the first position and the second position.

* * * * *